US008182409B2

(12) United States Patent
Hoffmann

(10) Patent No.: US 8,182,409 B2
(45) Date of Patent: May 22, 2012

(54) CENTRIFUGE COMPRISING MAGNETICALLY COUPLED ROTATING BASKET

(75) Inventor: Jeffrey R. Hoffmann, Fairfield, OH (US)

(73) Assignee: The Western States Machine Company, Hamilton, OH (US)

( * ) Notice: Subject to any disclaimer, the term of this patent is extended or adjusted under 35 U.S.C. 154(b) by 925 days.

(21) Appl. No.: 12/207,132

(22) Filed: Sep. 9, 2008

(65) Prior Publication Data

US 2010/0062922 A1 Mar. 11, 2010

(51) Int. Cl.
*B04B 9/00* (2006.01)

(52) U.S. Cl. ..... 494/84; 210/380.1; 403/DIG. 1

(58) Field of Classification Search ..... 494/12, 494/60, 82–84; 210/360.1–380.3; 403/DIG. 1; 464/29

See application file for complete search history.

(56) References Cited

U.S. PATENT DOCUMENTS

| | | | | |
|---|---|---|---|---|
| 2,147,204 | A * | 2/1939 | Laird | 464/29 |
| 3,856,200 | A * | 12/1974 | Lieb | 494/82 |
| 3,882,716 | A | 5/1975 | Beiman | |
| 3,902,659 | A * | 9/1975 | Brinkmann et al. | 494/82 |
| 4,115,040 | A * | 9/1978 | Knorr | 417/420 |
| 4,226,669 | A | 10/1980 | Vilardi | |
| 4,285,463 | A | 8/1981 | Intengan | |
| 4,402,715 | A * | 9/1983 | Ruyak et al. | 55/317 |
| 4,772,254 | A | 9/1988 | Grassl et al. | |
| 5,407,197 | A * | 4/1995 | Parsons | 463/47.7 |
| 5,538,493 | A | 7/1996 | Gerken et al. | |
| 5,683,341 | A | 11/1997 | Giebeler | |
| 5,720,160 | A | 2/1998 | Traxler et al. | |
| 6,280,375 | B1 | 8/2001 | Meisberger et al. | |
| 6,296,125 | B1 | 10/2001 | Dudley | |
| 6,440,055 | B1 | 8/2002 | Meisberger | |
| 6,863,466 | B2 * | 3/2005 | Buhren | 403/383 |
| 2002/0006830 | A1 * | 1/2002 | Buhren | 464/29 |
| 2002/0183184 | A1 | 12/2002 | Takahashi et al. | |
| 2006/0111191 | A1 * | 5/2006 | Wise | 464/29 |
| 2010/0062922 | A1 * | 3/2010 | Hoffmann | 494/12 |
| 2010/0135109 | A1 * | 6/2010 | Drees | 366/274 |

FOREIGN PATENT DOCUMENTS

| | | | |
|---|---|---|---|
| DE | 2123654 | A1 | 11/1972 |
| DE | 19735148 | C1 | 3/1999 |
| EP | 2161079 | A1 * | 3/2010 |

OTHER PUBLICATIONS

Extended European Search Report dated Jan. 18, 2010 pertaining to European Patent Application No. 09169670.8.

* cited by examiner

*Primary Examiner* — Charles E Cooley
(74) *Attorney, Agent, or Firm* — Dinsmore & Shohl LLP

(57) ABSTRACT

Embodiments of a centrifuge comprise a housing, a rotatable shaft extending upwardly into the housing and comprising a rare earth metal magnet disposed adjacent an upper surface of the rotatable shaft and a centrifuge basket configured to rotate with the rotatable shaft and magnetically coupled to the rare earth metal magnet of the rotatable shaft.

18 Claims, 4 Drawing Sheets

CENTRIFUGE COMPRISING MAGNETICALLY COUPLED ROTATING BASKET

TECHNICAL FIELD

Embodiments of the present invention are generally directed to centrifuges, and are specifically directed to centrifuges comprising centrifuge baskets magnetically coupled to a rotatable shaft using rare earth magnets.

BACKGROUND

Centrifuges are well known devices utilized in a variety of industrial applications. Application of this centrifuge is for general solid-liquid separation in all chemical, food, and pharmaceutical applications. Due to the high rotational velocity required in the centrifuge, centrifuges may utilize a central bolt to secure the centrifuge basket to the rotatable shaft. However, the inclusion of the bolt produces areas under the bolt and down into the threaded recess that may provide sources for contamination of the materials being centrifuged These contamination areas may alter the final product produced by the centrifuge. For example, rust, dirt, or other contamination is not desirable in a centrifuge which is converting slurry into sugar. Consequently, centrifuge constructions which eliminate or minimize the contamination to potential sources of centrifuge are desirable.

SUMMARY

According to one embodiment, a centrifuge is provided to reduce the contamination caused by a central bolt securing the centrifuge basket to the rotating shaft. The centrifuge comprises a housing, and a rotatable shaft extending upwardly through the housing. The rotatable shaft comprises a rare earth metal magnet disposed adjacent an upper surface of the rotatable shaft. The centrifuge basket is configured to rotate with the rotatable shaft and is magnetically coupled to the rare earth metal magnet of the rotatable shaft.

According to a further embodiment, the rotatable shaft comprises a slot on at least one surface, and the centrifuge basket comprises a slot (or possibly multiple slots) on at least one surface. Additionally, the centrifuge comprises a locking insert configured prevent the rotation of the rotatable shaft relative to the centrifuge basket when the locking insert is disposed inside a locking receptacle. The locking receptacle is defined as the spacing formed when the rotatable shaft slot and the centrifuge basket slot are aligned.

These and additional features provided by the embodiments of the present invention will be more fully understood in view of the following detailed description, in conjunction with the drawings and appended claims.

BRIEF DESCRIPTION OF THE DRAWINGS

The following detailed description of specific embodiments of the present invention can be best understood when read in conjunction with the drawings enclosed herewith and where like elements are identified by like reference numbers in the several provided view.

Figure 1:
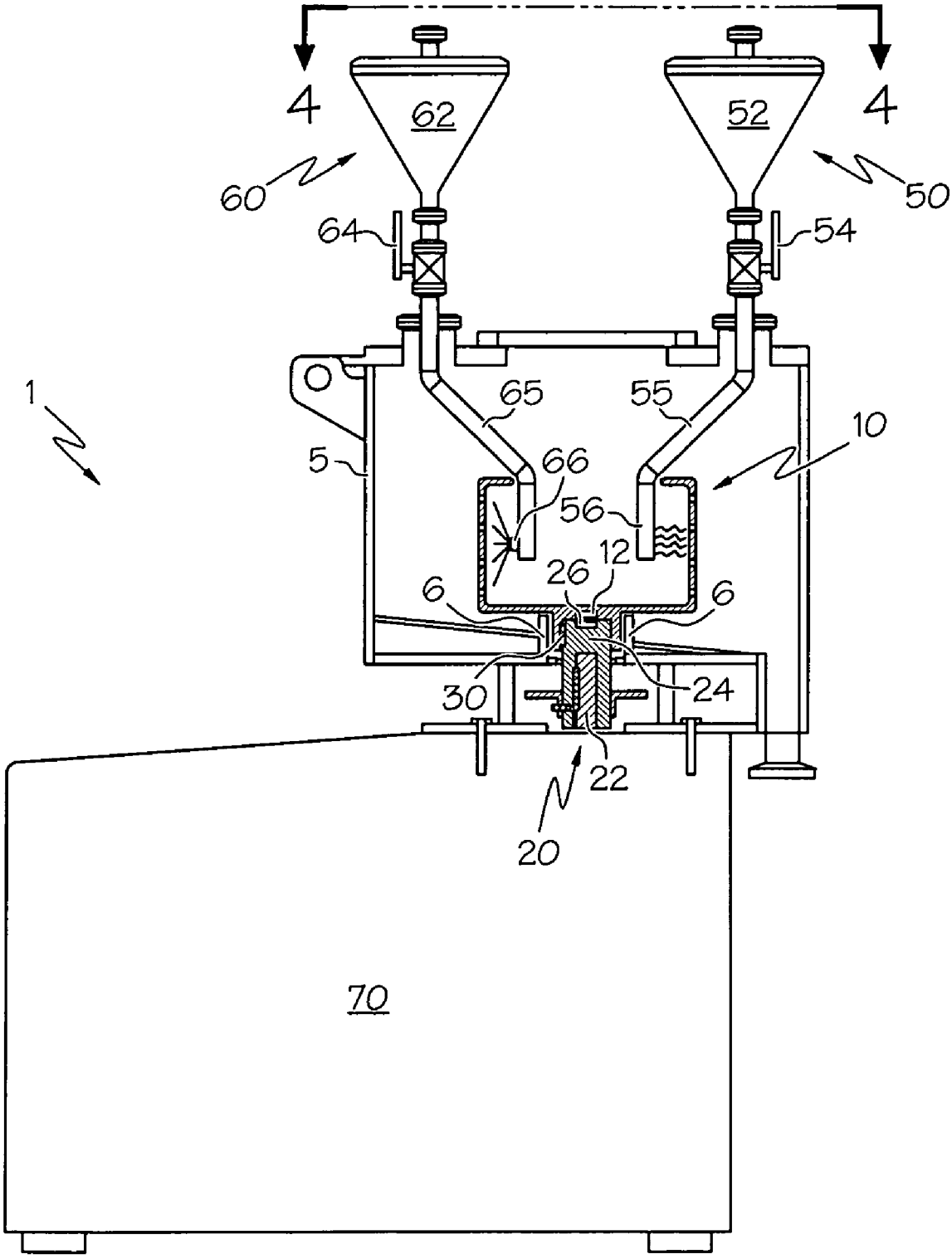
FIG. 1 is a schematic side cross-sectional view of the centrifuge according to one or more embodiments of the present invention.

The embodiments set forth in the drawings are illustrative in nature and not intended to be limiting of the invention defined by the claims. Moreover, individual features of the drawings and invention will be more fully apparent and understood in view of the detailed description.

DETAILED DESCRIPTION

Embodiments of the present invention are generally directed to a centrifuge comprising a centrifuge basket magnetically coupled to a rare earth metal magnet of the rotatable shaft. Rare-earth magnets provide the necessary force required to secure the centrifuge basket to the rotatable shaft, thereby eliminating the need for a central bolt to secure the rotatable shaft to the centrifuge basket. By eliminating the bolt, source of contamination caused by the bolt are eliminated. Furthermore, with the addition of the rare earth metal magnet and the elimination of the central bolt, the centrifuge basket and the rotatable shaft can be separated without the use of tools.

Referring to FIG. 1, a centrifuge 1 is provided, which comprises a housing 5, a rotatable shaft 20 extending upwardly into the housing 5, and a centrifuge basket 10 coupled to the rotatable shaft 20. As shown in greater detail in FIGS. 2A-2B, the rotatable shaft 20 comprises a rare earth metal magnet 26 disposed adjacent an upper surface of the rotatable shaft 20. The rare earth metal magnet 26 may include, but is not limited to, lanthanum, cerium, praseodymium, neodymium, promethium, samarium, gadolinium, dysprosium, thulium, ytterbium, or combinations thereof. In addition to rare earth metals, it is contemplated that other materials may also be included with the rare earth metals in the rare earth metal magnet 26. Traditional metal magnets or electromagnets are also contemplated herein. Although the embodiments shown in the present figures illustrate the rare earth metal magnet 26 recessed in the upper surface of the rotatable shaft 20, it is further contemplated that the rare earth metal magnet 26 may be included in the centrifuge basket 10 in addition to or instead of the rare earth metal magnet 26 in the rotatable shaft 20.

Figure 2B:
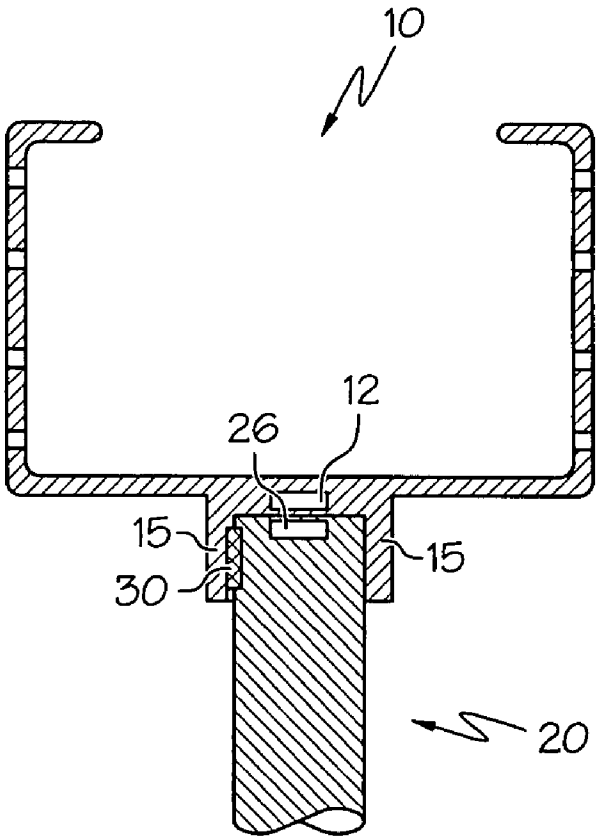
FIG. 2B is a cross-sectional view similar to FIG. 2A which illustrates the coupling of the rotatable shaft to the centrifuge basket according to one or more embodiments of the present invention.
Figure 2A:
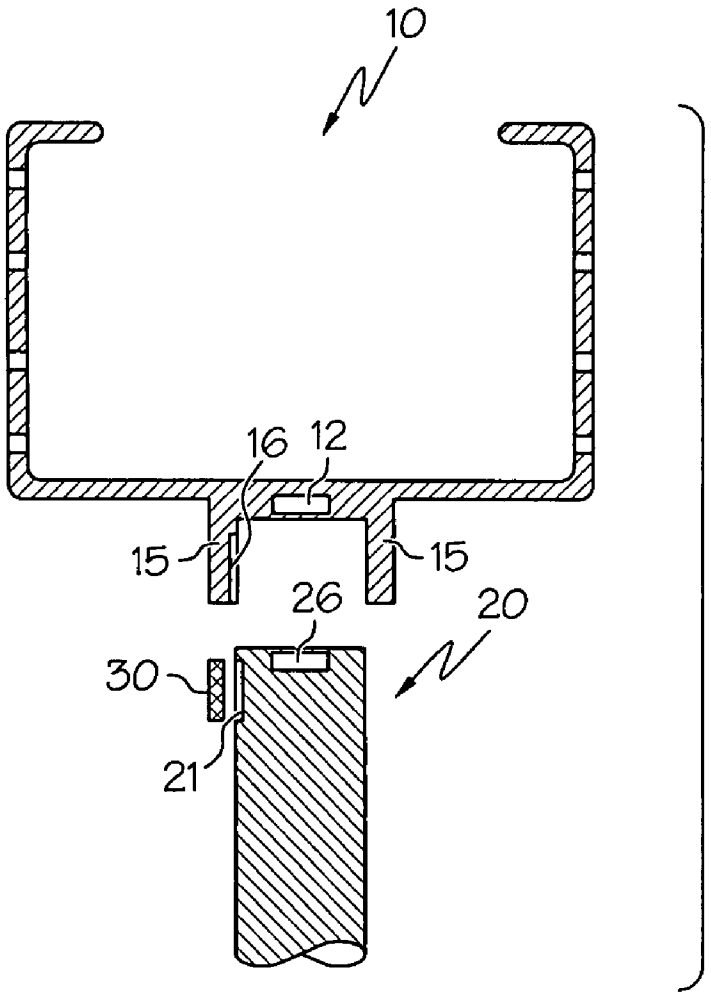
FIG. 2A is an exploded cross-sectional view of several components of the centrifuge of FIG. 1, for example, the centrifuge basket and the rotatable shaft, according to one or more embodiments of the present invention.

Referring again to FIGS. 2A-2B, the centrifuge basket 10 is disposed over the rotatable shaft 20, and comprises a material effective for magnetic coupling to the rare earth metal magnet 26 of the rotatable shaft 20. Materials effective for magnetic coupling include but are not limited to metals. In the embodiment as shown in FIGS. 2A-2B, the centrifuge basket 10 comprises a metallic component 12 (for example, a metallic block) disposed adjacent a bottom surface of the centrifuge basket 10. Although the metallic component 12 may include any suitable metallic based material or alloy operable to magnetically couple to the rare earth magnet 26, the metallic component 12, in one exemplary embodiment, may comprise a ferrous metal, carbon steel, or combinations thereof. To maximize the effectiveness of the magnetic coupling between the metallic component 12 and the rare earth metal magnet 26, it may be desirable to vertically align the metallic component 12 over the rare earth metal magnet 26 as shown in FIG. 2B.

Referring generally to FIGS. 1, 2A-2B, and 4, the centrifuge 1 further comprises a locking mechanism configured to prevent the rotation of the rotatable shaft 20 and the centrifuge basket 10. The rotatable shaft may include any suitable shape familiar to one of ordinary skill in the art (e.g., a cylindrical or square shaft). In one embodiment as shown in FIG. 2A, the rotatable shaft 20 comprises a slot 21 on at least one surface, and the centrifuge basket 10 also comprises a slot 16 on at least one surface. It is contemplated that one slot or multiple slots may be used. As shown in FIG. 2B, the rotatable shaft slot 21 and the centrifuge basket slot 16 are aligned when coupled together. The spacing formed by the alignment of the rotatable shaft slot 21 and the centrifuge basket slot 16 defines a locking receptacle for the rotatable shaft 20 and the centrifuge basket 10. As shown in FIG. 2B, the locking receptacle receives a locking insert 30, which prevents the rotation of the rotatable shaft 20 relative to the centrifuge basket 10. In essence, the locking mechanism comprises the locking receptacle (i.e., spacing formed by aligned slots 16 and 21) and the locking insert 30, which locks the rotatable shaft 20 when inserted into the locking receptacle. Other alternative locking mechanisms familiar to one of ordinary skill in the art are contemplated herein. To further ensure that the centrifuge basket 10 is secured to the rotatable shaft 20, the centrifuge basket 10 may also include a lower flange 15 extending from the bottom surface of the centrifuge basket 10, which may receive at least an upper portion of the rotatable shaft 20 as shown in FIGS. 2A-2B and 3A-3C.

Figure 3B:
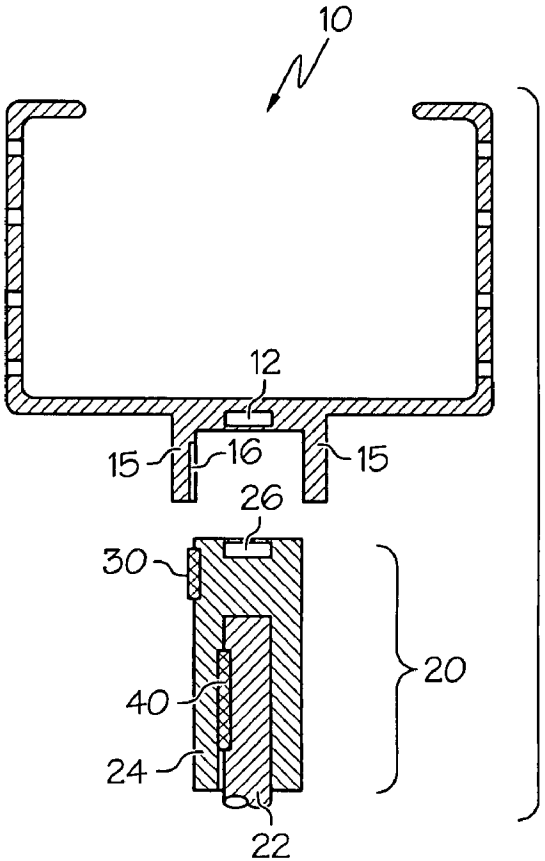
FIG. 3B is a cross-sectional view similar to FIG. 3A which illustrates the coupling of the components of the rotatable shaft according to one or more embodiments of the present invention.
Figure 3A:
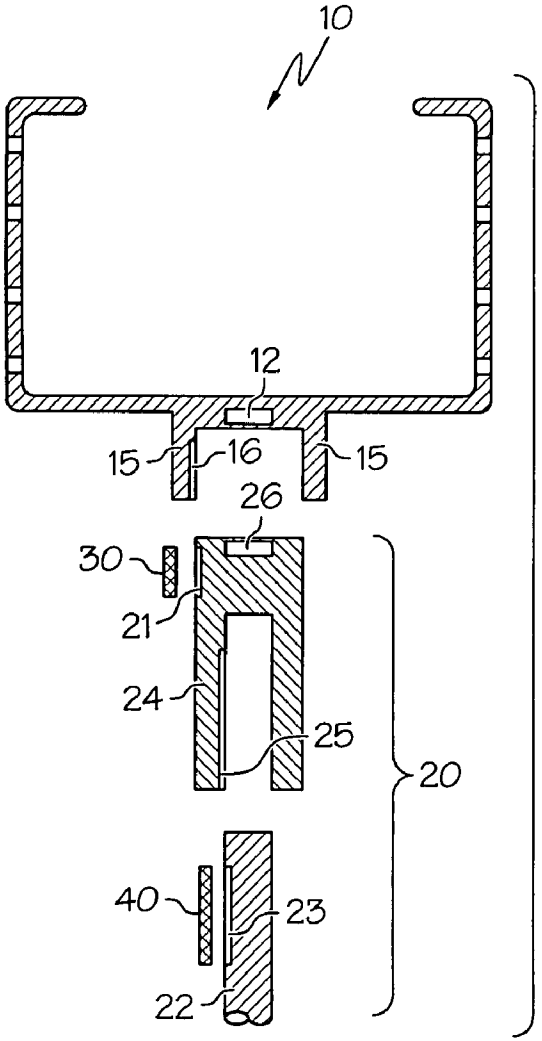
FIG. 3A is an exploded cross-sectional view of several components of the centrifuge of FIG. 1, for example, the centrifuge basket, the rotatable shaft, and the components of the rotatable shaft, according to one or more embodiments of the present invention.
Figure 3C:
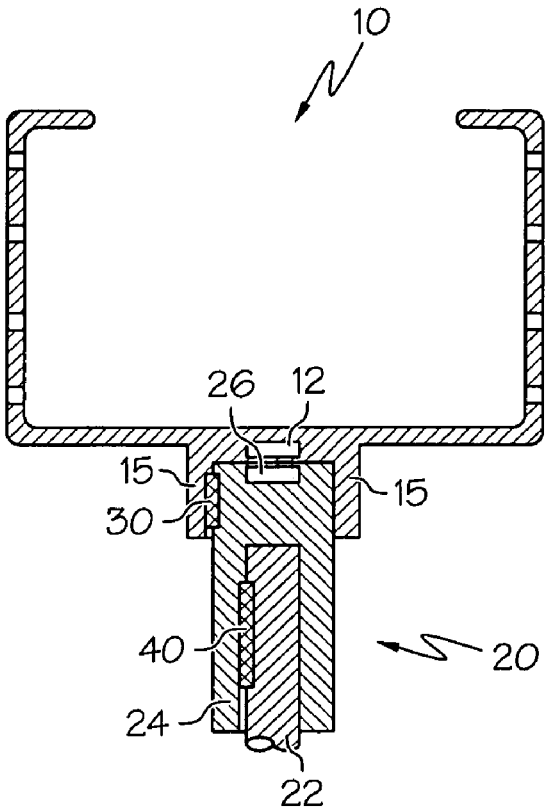
FIG. 3C is another cross-sectional view similar to FIG. 3A which illustrates the coupling of the rotatable shaft to the centrifuge basket according to one or more embodiments of the present invention.

In another embodiment shown in FIGS. 3A-3C, the rotatable shaft 20 comprises multiple sub-components. For example, the rotatable shaft 20 comprises a motorized shaft 22 driven by a motor (not shown) and an adaptor shaft 24 rotatable therewith. The adaptor shaft 24 may have a cavity formed by removing material from a first end, the cavity herein called a bore. The motorized shaft 22 may be disposed at least partially within the bore of the adaptor shaft 24. Further as shown, the adaptor shaft 24 comprises the rare earth metal magnet 26 configured to magnetically couple to the centrifuge basket 10.

Like the coupling of the centrifuge basket 10 and the rotatable shaft 20, the adaptor shaft 24 and the motorized shaft 22 must also be secured together. In one embodiment, the motorized shaft 22 comprises a slot 23 on at least one surface, and the adaptor shaft 24 comprises a slot 25 on at least one surface. Like above, one or multiple slots 25 are contemplated herein. Also, the adaptor shaft 24 may comprise any suitable shape (e.g., a cylindrical or square shape). When the motorized shaft slot 23 and the adaptor shaft slot 25 are aligned, the spacing formed by the alignment of slots 23 and 25 defines a locking receptacle. Similar to the centrifuge basket 10 and the rotatable shaft 20, the locking receptacle receives a locking insert 40 to secure the motorized shaft 22 and the adaptor shaft 24 to each other. The motorized shaft 22 may be coupled to the adaptor shaft 24 by being keyed, splined, or fixed with set screw(s).

Figure 4:
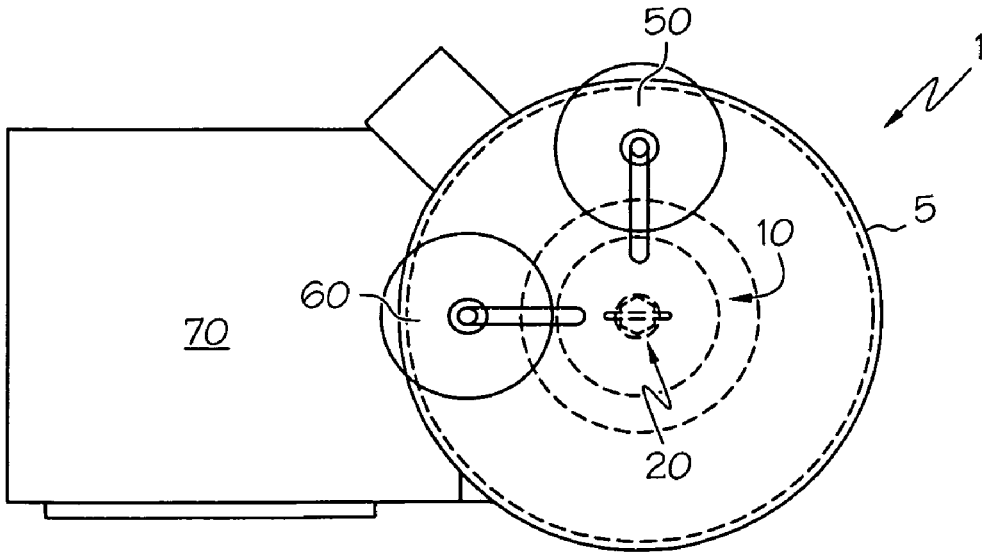
FIG. 4 is a top cross-sectional view of the centrifuge of FIG. 1 taken along line 4-4 according to one or more embodiments of the present invention.

In further embodiments as shown in FIGS. 1 and 4, the housing 5 of the centrifuge 1 comprises a dam 6 extending from the lower surface of the housing 5. The dam 6, which prevents liquids from flowing down the rotatable shaft 20 is in proximity to the lower flange 15 of the centrifuge basket 10 and the upper portion of the rotatable shaft 20 disposed therein. Moreover, the centrifuge 1 may comprise a plurality of feed mechanisms disposed adjacent the housing, for example, a slurry feed 50 stream and a wash feed stream 60 as shown in FIGS. 1 and 4. As shown in the embodiment of FIG. 1, the feed mechanisms 50 and 60 may include a hopper 52, and 62 respectively. In other embodiments, the slurry feed may be fed simply by opening the vessel lid and placing or pouring the slurry (especially in the case of a viscous slurry) directly into the basket 10. The feed mechanisms 50, 60 may also include valves 54 and 64, piping (e.g., curved piping 55,65), and spray nozzles 56, 66 disposed at the bottom of the piping 55, 65, respectively. As would be familiar to one of ordinary skill in the art, the centrifuge 1 may also comprise various additional components (not shown) configured to control and drive the operation of the centrifuge 1. As shown in FIGS. 1 and 4, housing 70 may include therein motors, braking equipment, control equipment, and other components familiar to one of ordinary skill in the art.

For the purposes of describing and defining the present invention it is noted that the terms "substantially" and "about" are utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Having described the invention in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these aspects of the invention.

What is claimed is:

1. A centrifuge comprising:

a housing;

a rotatable shaft extending upwardly into the housing and comprising a rare earth metal magnet disposed adjacent an upper surface of the rotatable shaft; and a centrifuge basket configured to rotate with the rotatable shaft and magnetically coupled to the rare earth metal magnet of the rotatable shaft;

wherein the rotatable shaft comprises a motorized shaft and an adaptor shaft rotatable therewith, the motorized shaft being disposed at least partially within a bore of the adaptor shaft, wherein the adaptor shaft comprises the rare earth metal magnet configured to magnetically couple to the centrifuge basket.

2. The centrifuge of claim 1 further comprising a locking mechanism configured to prevent the rotation of the rotatable shaft relative to the centrifuge basket.

3. The centrifuge of claim 1 wherein the adaptor shaft comprises a slot on at least one surface and the centrifuge basket comprises a slot on at least one surface, wherein when the adaptor shaft slot and the centrifuge basket slot are aligned, the spacing formed by the alignment of the adaptor shaft slot and the centrifuge basket slot defines a locking receptacle for the adaptor shaft and the centrifuge basket.

4. The centrifuge of claim 3 further comprising a locking insert configured to be inserted into the locking receptacle to prevent the rotation of the adaptor shaft relative to the centrifuge basket.

5. The centrifuge of claim 1 wherein the rare earth metal magnet comprises lanthanum, cerium, praseodymium, neodymium, promethium, samarium, gadolinium, dysprosium, thulium, ytterbium, or combinations thereof.

6. The centrifuge of claim 1 wherein the motorized shaft comprises a slot on at least one surface and the adaptor shaft comprises a slot on at least one surface, wherein when the motorized shaft slot and the adaptor shaft slot are aligned, the spacing formed by the alignment of motorized shaft slot and the adaptor shaft slot defines a locking receptacle for the motorized shaft and the adaptor shaft.

7. The centrifuge of claim 6 further comprising a locking insert configured to be inserted into the locking receptacle to prevent the rotation of the motorized shaft relative to the adaptor shaft.

8. The centrifuge of claim 1 wherein the centrifuge basket comprises a metallic component disposed adjacent a bottom surface of the centrifuge basket.

9. The centrifuge of claim 8 wherein the metallic component comprises carbon steel.

10. The centrifuge of claim 8 wherein the metallic component is vertically aligned over the rare earth metal magnet.

11. The centrifuge of claim 1 wherein the centrifuge basket comprises a lower flange extending from the bottom surface of the centrifuge basket, wherein at least an upper portion of the rotatable shaft or adaptor shaft is disposed within the lower flange.

12. The centrifuge of claim 11 wherein the housing comprises a plurality of support beams extending from the lower surface thereof and at least partially surrounding the lower flange and the upper portion of shaft disposed therein.

13. The centrifuge of claim 1 further comprising a plurality of feed mechanisms disposed adjacent the housing.

14. A centrifuge comprising:

a housing;

a rotatable shaft extending upwardly into the housing, wherein the rotatable shaft comprises a slot on at least one surface and a rare earth metal magnet disposed adjacent an upper surface of the rotatable shaft;

a centrifuge basket configured to rotate with the rotatable shaft, wherein the centrifuge basket comprises a slot on at least one surface and a metallic component magnetically coupled to the rare earth metal magnet of the rotatable shaft; and a locking insert being configured to prevent the rotation of the rotatable shaft relative to the centrifuge basket when the locking insert is disposed inside a locking receptacle, formed when the rotatable shaft slot and the centrifuge basket slot are aligned.

15. The centrifuge of claim 14 wherein the rare earth metal comprises lanthanum, cerium, praseodymium, neodymium, promethium, samarium, gadolinium, dysprosium, thulium, ytterbium, and combinations thereof.

16. The centrifuge of claim 14 wherein the centrifuge basket comprises a metallic component disposed adjacent a bottom surface of the centrifuge basket.

17. The centrifuge of claim 16 wherein the metallic component comprises carbon steel.

18. The centrifuge of claim 16 wherein the metallic component is vertically aligned over the rare earth metal magnet.

* * * * *